US007747199B2

(12) United States Patent
Koido

(10) Patent No.: US 7,747,199 B2
(45) Date of Patent: Jun. 29, 2010

(54) DEVELOPER MATERIAL CONTAINER, IMAGE FORMING UNIT, AND IMAGE FORMING APPARATUS

(75) Inventor: Sigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 192 days.

(21) Appl. No.: 11/892,733

(22) Filed: Aug. 27, 2007

(65) Prior Publication Data

US 2008/0056759 A1 Mar. 6, 2008

(30) Foreign Application Priority Data

Aug. 31, 2006 (JP) ..... 2006-235647
Oct. 27, 2006 (JP) ..... 2006-292575

(51) Int. Cl.
*G03G 15/08* (2006.01)

(52) U.S. Cl. ..... 399/262

(58) Field of Classification Search ..... 399/106, 399/119, 120, 262
See application file for complete search history.

(56) References Cited

FOREIGN PATENT DOCUMENTS

JP 07065564 A * 3/1995
JP 2003-050505 2/2003
JP 2005227614 A * 8/2005

OTHER PUBLICATIONS

Machine translation of JP 2005-227614.*

* cited by examiner

*Primary Examiner*—David M Gray
*Assistant Examiner*—Andrew V Do
(74) *Attorney, Agent, or Firm*—Rabin & Berdo, PC

(57) ABSTRACT

A developer material container includes a holding body, a shutter member movably, an operation member, and coupling member. The holding body holds developer therein and includes a developer outlet. The shutter member movably is assembled to the holding body. The shutter member is movable either to an opening position where the shutter member opens the developer outlet or to a closing position where the shutter member closes the developer outlet. The operation member is operated to move the shutter to either the opening position or to the closing position. Depending on the orientation of the discharging opening, an enabling-and-disabling member allows or does not allow the operation member to move the shutter relative to the holding body.

17 Claims, 15 Drawing Sheets

DEVELOPER MATERIAL CONTAINER, IMAGE FORMING UNIT, AND IMAGE FORMING APPARATUS

BACKGROUND OF THE INVENTION

1. Field of the Invention

The present invention relates to a developer material container, an image forming unit, and an image forming apparatus.

2. Description of the Related Art

Among conventional image forming apparatuses are electrophotographic printers, copying machines, facsimile machines, and multi function peripheral (MFP) devices capable of various tasks such as printing, faxing, and copying. For example, a printer includes image forming units each of which includes, for example, a photoconductive drum, a charging unit, an exposing unit, and a developing unit. The charging unit charges the surface of the photoconductive drum uniformly. The exposing unit includes an LED print head that illuminates the charged surface of the photoconductive drum to form an electrostatic latent image. The developing unit develops the electrostatic latent image with toner into a toner image. A transfer roller transfers the toner image onto paper. Then, a fixing unit fixes the toner image on the paper into a permanent image.

A toner cartridge serves as a developer material container and is detachably attached to the image forming unit. The developing unit has a toner receiving opening formed therein. The toner cartridge has a toner outlet formed in its bottom wall. The toner outlet is closed and opened with a shutter. When a user operates an operation lever of the shutter to open the shutter, the toner is discharged from the toner cartridge into the developing unit through the toner receiving opening.

A conventional toner cartridge is configured such that the shutter may be opened and closed with the toner outlet facing upward. Therefore, opening the shutter inadvertently may allow foreign matter to enter the toner cartridge.

SUMMARY OF THE INVENTION

The present invention was made in view of the aforementioned problems.

An object of the invention is to provide a developer material container that prevents foreign matter from entering, an image forming unit that employs the developer material container, and an image forming apparatus that employs the image forming unit.

A developer material container includes:

a holding body that holds a developer material therein, the holding body including a discharging opening;

a shutter member movably assembled to the holding body, the shutter member being movable either to an opening position where the shutter member opens the discharging opening or to a closing position where the shutter member closes the discharging opening;

an operation member operated to move the shutter member to either the opening position or to the closing position; and an enabling-and-disabling member that allows or does not allow said operation member to move said shutter relative to said holding body depending on the orientation of the discharging opening.

The enabling-and-disabling member allows said shutter member to move relative to said holding body when said the developer material container is held with the discharging opening facing upwardly in a gravitational direction, and does not allow said shutter member to move relative to said holding body when the developer material container is held with the discharging opening facing downwardly in the gravitational direction.

The enabling-and-disabling member couples the shutter member to the holding body when the developer material container is held with the discharging opening facing upwardly in a gravitational direction, and decouples the shutter member from the holding body when the developer material container is held with the discharging opening facing downwardly in the gravitational direction.

The enabling-and-disabling member is supported on the shutter member such that the enabling-and-disabling member is pivotal by gravity, the enabling-and-disabling member including an engagement portion at a free end thereof, the engagement portion being engageable with an engagement portion formed on the holding body.

The operation member and the shutter are separate components. When the developer material container is held with the discharging opening facing upwardly in a gravitational direction, the enabling-and-disabling member decouples the shutter member from the operation member. When the developer material container is held with the discharging opening facing downwardly in a gravitational direction, the enabling-and-disabling member couples the shutter member to the operation member.

The enabling-and-disabling member is pivotally supported on the shutter member, the enabling-and-disabling member including an engagement portion at a free end thereof, the engagement portion being engageable with an engagement portion formed in the operation member.

The shutter member includes a first recess and the operation member includes a second recess. When the enabling-and-disabling member couples the operation member to the shutter member, the enabling-and-disabling member is movable in the first recess and the second recess by gravity.

The enabling-and-disabling member may be a pin.

When the developer material container is held with the discharging opening facing downwardly in a gravitational direction, the enabling-and-disabling member (320) couples the shutter member to the operation member. When the developer material container is held with the discharging opening facing upwardly in a gravitational direction, the enabling-and-disabling member decouples the shutter member from the operation member. When the developer material container is tilted by an angle in a vertical plane from a position where the developer material container is held with the discharging opening facing upwardly in a gravitational direction, the enabling-and-disabling member decouples the shutter member from the operation member.

The shutter member includes a first tapered recess and the operation member includes a second tapered recess. The enabling-and-disabling member is movable in the first tapered recess and the second tapered recess by gravity when the shutter member is positioned relative to the operation member such that the first tapered recess is in alignment with second tapered recess.

An image forming unit incorporates the aforementioned developer material container.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAIL DESCRIPTION OF THE INVENTION

Embodiments of the present invention will be described with reference to the accompanying drawings. Byway of example, an image forming apparatus will be described in terms of a color printer.

First Embodiment

Figure 1:
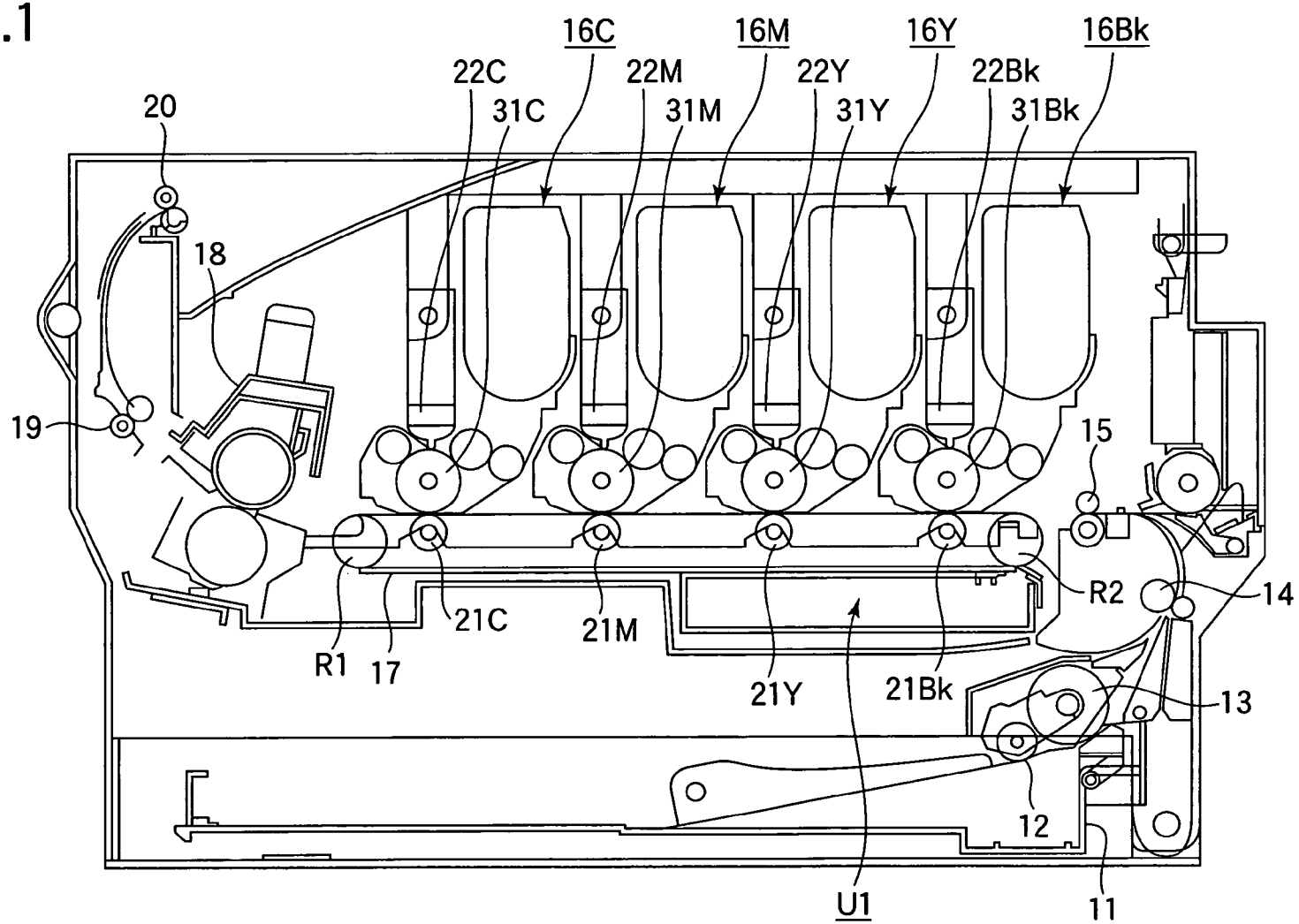
FIG. 1 illustrates a general configuration of a printer of a first embodiment.

FIG. 1 illustrates a general configuration of a printer of a first embodiment.

Referring to FIG. 1, a paper cassette 11 is located at a lower portion of the printer. The paper cassette 11 holds paper (not shown) as a recording medium. A paper feeding mechanism is disposed adjacent a forward end of the paper cassette 11, and feeds the paper on a page-by-page basis. The paper feeding mechanism includes a feed roller 12 and a separator roller 13. The paper fed by the paper feeding mechanism is then advanced to a transporting roller 14 disposed above the paper feeding mechanism. The paper is further transported by another transporting roller 15 to image forming units 16BK (black), 16Y (yellow), 16M (magenta), and 16C (cyan) that form black, yellow, magenta, and cyan images, respectively.

The image forming units 16BK, 16Y, 16M, and 16C include photoconductive drums 31BK (black), 31Y (yellow), 31M (magenta) and 31C (cyan), respectively. LED printheads (exposing units) 22BK, 22Y, 22M, and 22C are disposed adjacent the image forming units 16BK, 16Y, 16M, and 16C, respectively, and parallel the photoconductive drums (image bearing body) 31BK, 31Y, 31M, and 31C. The LED print heads oppose the corresponding photoconductive drums.

A transfer unit U1 is disposed to extend along a row of the image forming units 16BK, 16Y, 16M, and 16C. The transfer unit U1 includes a drive roller R1, a driven roller R2, a transport belt 17, and transfer rollers 21BK (black), 21Y (yellow), 21M (magenta), and 21C (cyan) The transport belt 17 is entrained about the drive roller R1 and the driven roller R2. The transfer rollers (transfer members) 21BK, 21Y, 21M, and 21C parallel the photoconductive drums 31BK, 31Y, 31M, and 31C, respectively. The transport belt 17 runs from upstream to downstream of a paper transport path, being sandwiched between the photoconductive drums 31BK, 31Y, 31M, and 31C and the transfer rollers 21BK, 21Y, 21M, and 21C, respectively.

The transport belt 17 runs with the paper placed thereon, passing through transfer points defined between the transfer rollers 21BK, 21Y, 21M, and 21C and the photoconductive drums 31BK, 31Y, 31M, and 31C, respectively. As the paper passes through the transfer points, toner images of the respective colors are transferred onto the paper one over the other in registration to form a full color toner image.

The paper is then advanced to a fixing unit 18. As the paper passes through the fixing unit 18, the full color toner image is fused into a permanent full color image. The paper then leaves the fixing unit 18, is further advanced by a transport roller 19, and is finally discharged by a discharging roller 20 onto a stacker.

{Image Forming Units}

The image forming units 16BK, 16Y, 16M, and 16C will be described.

Each of the image forming units 16BK, 16Y, 16M, and 16C may be substantially identical; for simplicity, only the operation of the black image forming unit 16BK will be described, it being understood that the remaining image forming units may work in a similar fashion.

Figure 2:
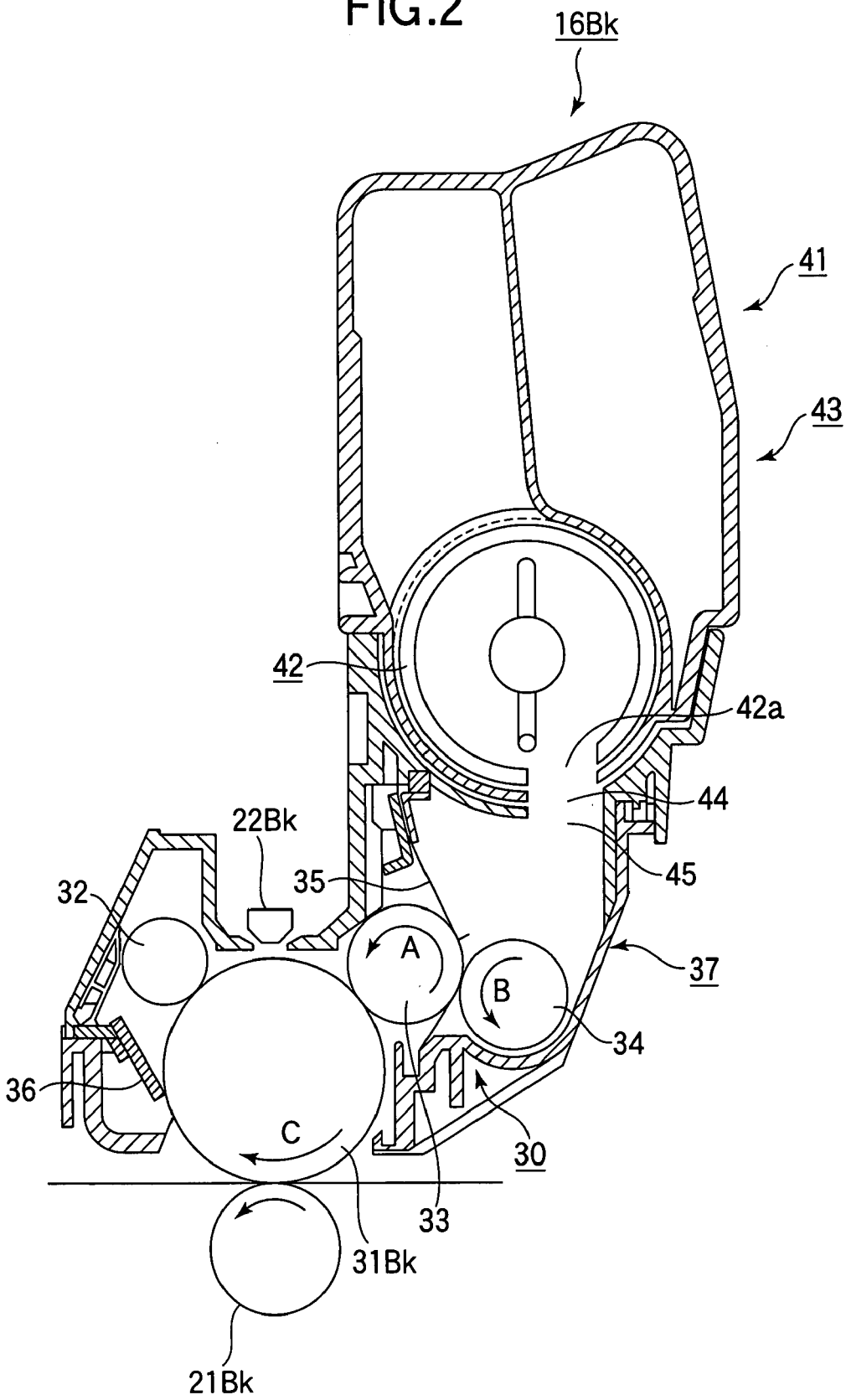
FIG. 2 is a cross-sectional view illustrating an image forming unit when it is assembled to an image forming apparatus.

FIG. 2 is a cross-sectional view illustrating the image forming unit 16BK when it is assembled to the image forming apparatus.

Referring to FIG. 2, the image forming unit 16BK includes a body 37 and a toner cartridge (developer material container) 41 detachably attached to the body 37. The toner cartridge 41 supplies toner into the developing unit 30 in the body 37. The toner cartridge 41 includes a casing 43 having a toner outlet (discharging opening) 44 formed in a bottom wall of the casing 43. A shutter 42 is movably attached to the casing 43 so that the toner outlet 44 may be opened and closed by operating the shutter 42. The shutter 42 includes an opening 42*a* formed therein and an operation lever (operation member) 42*b* (FIG. 3) in one piece with the shutter 42. Alternatively, the operation lever 42*b* may be assembled to the shutter 42 by means of a fastening member. When a user operates the operation lever 42*b* to a position where the opening 42*a* overlaps with or is in alignment with the toner outlet 44, the toner is discharged from the toner cartridge 41 through the opening 42*a* and the toner outlet 42. When the user operates the operation lever 42*b* to a position where the opening 42*a* does not overlap with or is not in alignment with the toner outlet 44, the toner outlet 44 is completely closed.

The body 37 includes a mounting portion having a substantially concave bottom surface that receives the toner cartridge 41 therein. A toner receiving opening 45 is formed in the bottom surface such that when the toner cartridge 41 is attached into the mounting portion, the toner outlet 44 becomes aligned with the toner receiving opening 45. Thus, when the toner outlet 44 is opened, the toner is supplied from the toner cartridge 41 into the body 37 through the toner receiving opening 45.

A charging roller 32 charges the entire circumferential surface of the photoconductive drum 31BK uniformly. A toner supplying roller 34 supplies the toner to the developing roller 33. A developing blade 35 forms a thin layer of toner on the surface of the developing roller 33. A developing roller 33 holds the thin layer of toner formed thereon. A cleaning blade 36 scrapes residual toner off the photoconductive drum 31BK after the toner image has been transferred onto the paper.

The photoconductive drum 31BK includes a conductive base layer formed of, for example, aluminum, and a surface layer formed of an organic photoconductive material. The charging roller 32 includes a metal shaft covered with a semiconductive rubber material (e.g., epichlorohydrin rubber) in the shape of a roll. The developing roller 33 includes a metal shaft covered with a semiconductive rubber material such as silicone. The toner supplying roller 34 includes a metal shaft covered with a foamed rubber material to which a foaming agent has been added during the kneading process for improving the ability of the toner supplying roller 34 to transport the toner.

{Operation of Image Forming Unit}

The image forming unit 16BK of the aforementioned configuration operates as follows:

The charging roller 32, developing roller 33, and cleaning blade 36 are disposed in contact with the photoconductive drum 31BK. The toner supplying roller 34 and developing blade 35 are in contact with the developing roller 33. Power supplies (not shown) for the developing roller 33, toner supplying roller 34, and developing blade 35 are connected to the developing roller 33, toner supplying roller 34, and developing blade 35, respectively, to supply bias voltages to them.

During printing, a drive motor (not shown) drives the developing roller 33 and toner supplying roller 34 to rotate in directions shown by arrows A and B, respectively, so that the toner supplying roller 34 supplies the toner to the developing roller 33. As the developing roller 33 rotates in contact with the developing blade 35, the developing blade 35 forms a thin layer of toner on the developing roller 33. As the developing roller 33 rotates in contact with the photoconductive drum 31BK, the thin layer of toner on the developing roller 33 is brought into contact with the electrostatic latent image formed on the photoconductive drum 31BK to develop the electrostatic latent image into a toner image.

A drum motor (not shown) drives the photoconductive drum 31BK in a direction shown by arrow C. As the photoconductive drum 31Bk rotates, the charging roller 32 charges the entire circumferential surface of the photoconductive drum 31Bk uniformly, and subsequently the LED print head 22BK illuminates the charged surface of the photoconductive drum 31Bk to form an electrostatic latent image. As the photoconductive drum 31BK further rotates, the electrostatic latent image is brought into contact with the thin layer of toner formed on the developing roller 33, being developed with the toner into a toner image.

Figure 3:
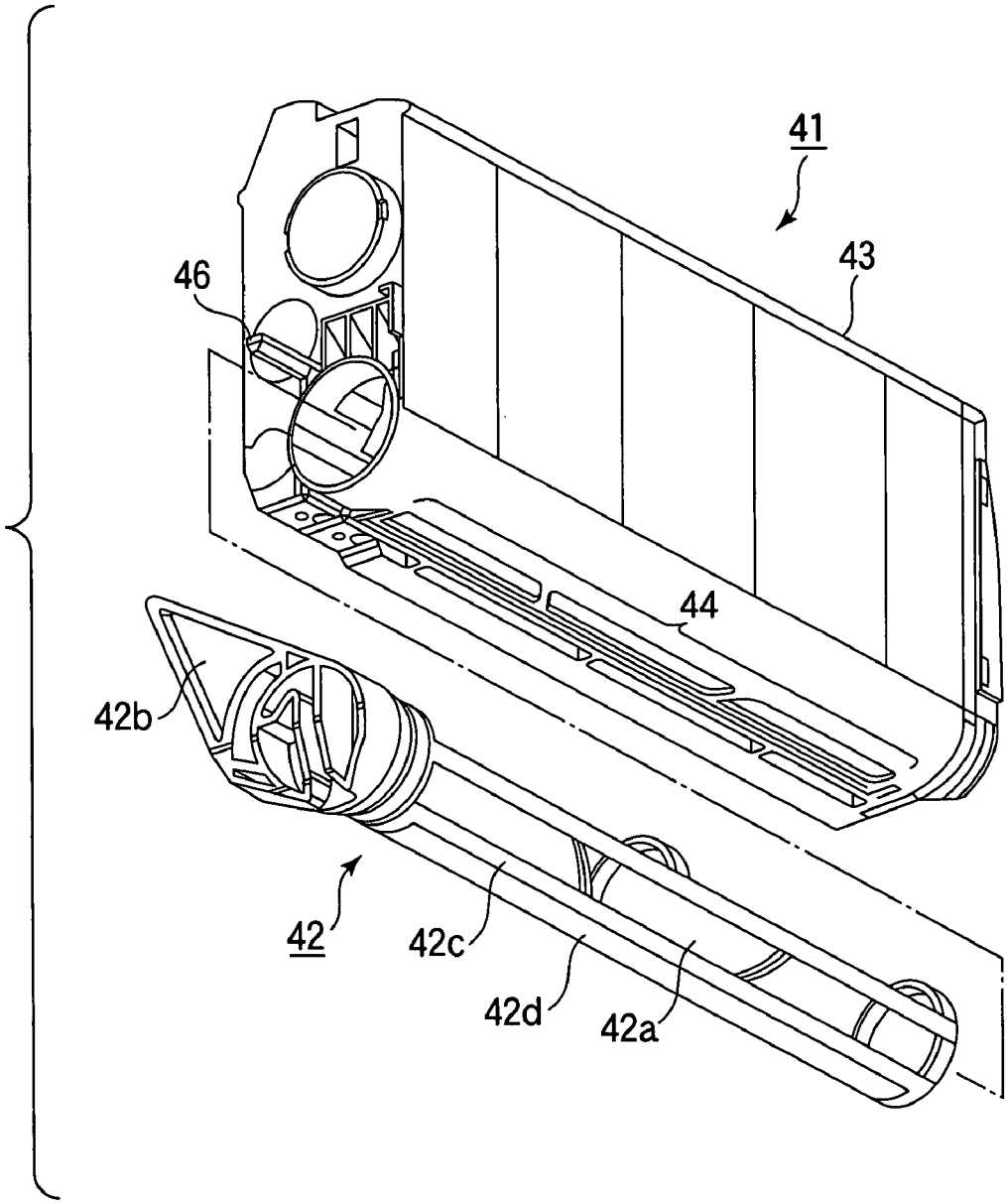
FIG. 3 is an exploded perspective view of a toner cartridge of the first embodiment.
Figure 4:
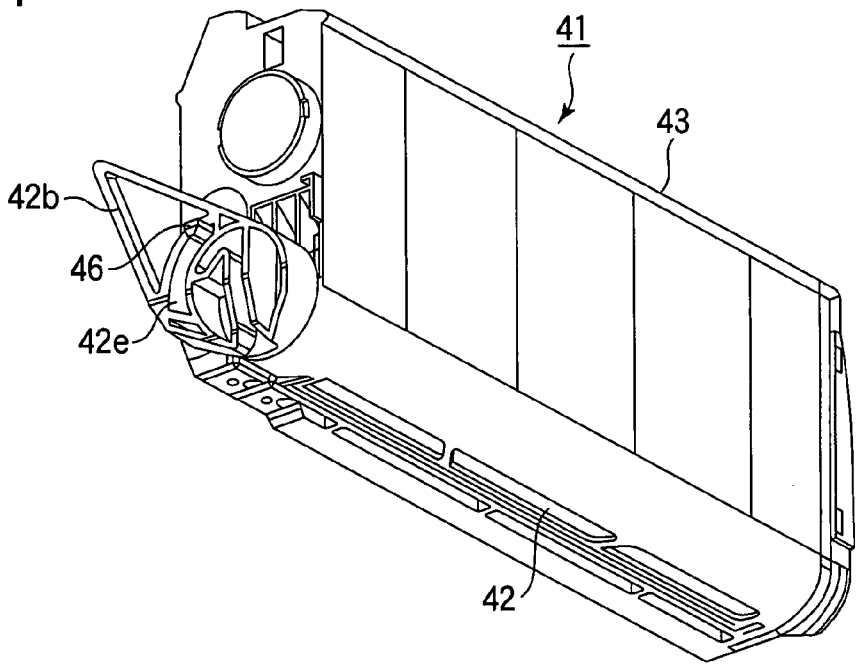
FIG. 4 illustrates a shutter when it is closed.
Figure 5:
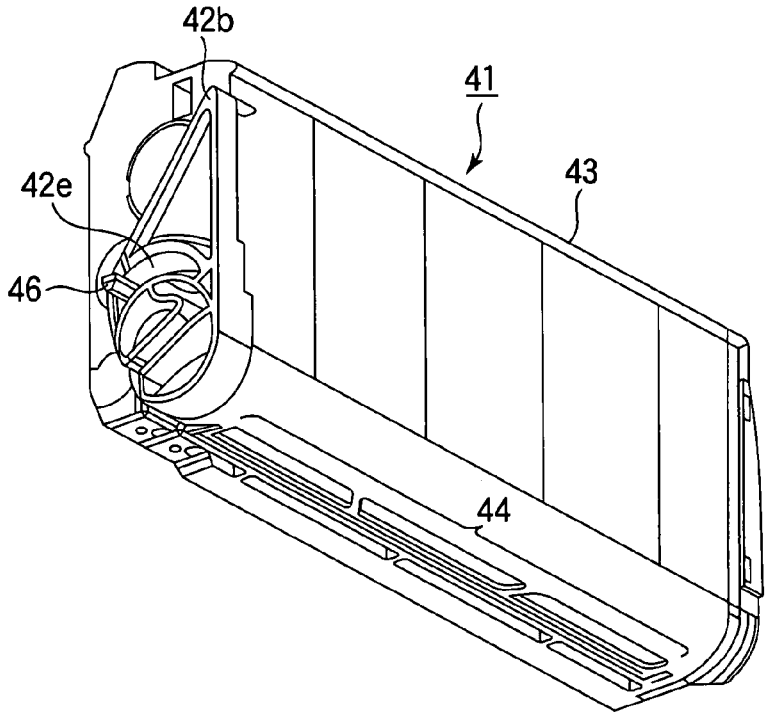
FIG. 5 illustrates the shutter when it is opened.

FIG. 3 is an exploded perspective view of the toner cartridge 41 of the first embodiment. FIG. 4 illustrates the shutter 42 when it is closed. FIG. 5 illustrates the shutter 42 when it is opened.

Referring to FIG. 3, the toner cartridge 41 includes the casing 43 that holds the toner therein. The toner outlet 44 is formed in the bottom wall of the casing 43. The shutter 42 includes the opening 42*a* that opens and close the toner outlet 44 and an arcuate wall 42*c* that closes the toner outlet 44. A sealing member 42*d* is bonded, for example, by an adhesive to the shutter 42 to surround the opening 42*a*, preventing the fresh toner from leaking out of the toner cartridge 41. The shutter also includes the operation lever 42*b* in one piece construction with the shutter 42. The shutter 42 is attached to the casing 43 such that the stopper 46 extends through an arcuate through hole 4*e* formed in the operation lever 42*b*. The operation lever 42*b* may be pivoted through an angle from an angular position (closing position, FIG. 4) where the stopper 46 abuts one longitudinal end of the through hole 4*e* to another angular position (opening position, FIG. 5) where the stopper 46 abuts the another end of the through hole 4*e*. A stopper 46 is formed on the casing 43 for limiting the pivotal motion of the operation lever 42*b*.

Pushing the stopper 46 into the casing 43 allows the operation lever 42*b* to pivot. The operation lever 42*b* may be pivoted until the operation lever 42*b* abuts the stopper 46 to bring the opening 42*a* into alignment with the toner outlet 44 such that the opening 42*a* is completely opened.

Figure 6A:
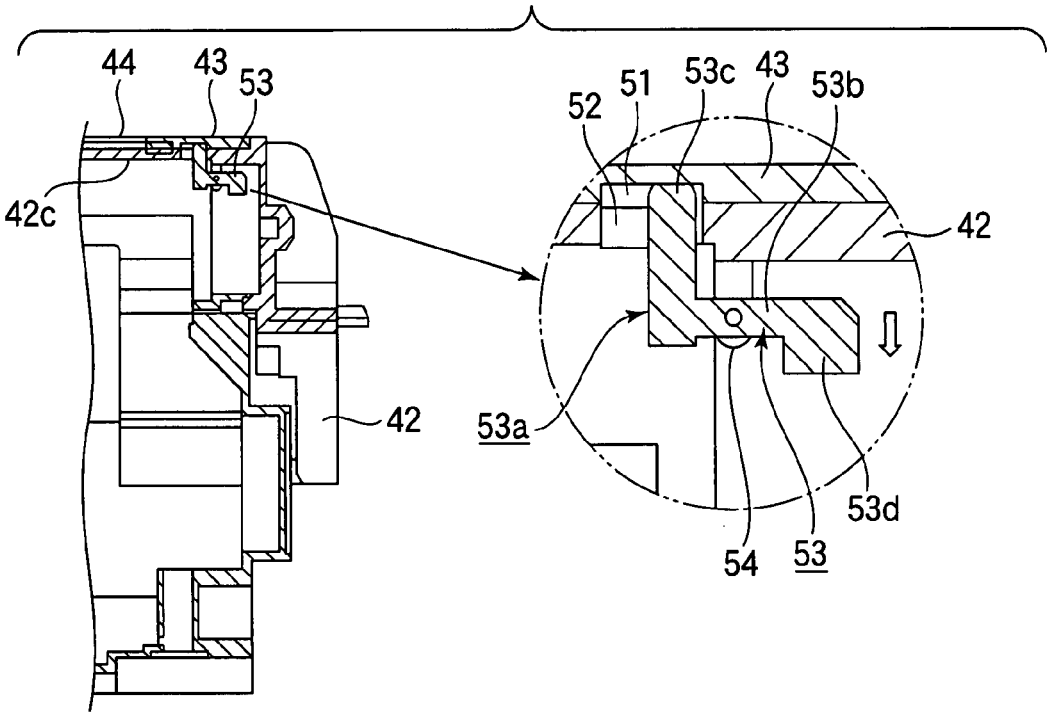
FIG. 6A is a cross-sectional view illustrating a pertinent portion of the toner cartridge.
Figure 7:
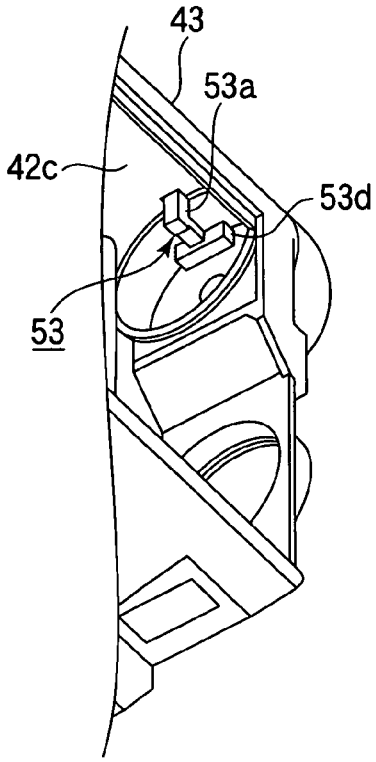
FIG. 7 is a perspective view illustrating a pertinent portion of the toner cartridge.
Figure 6B:
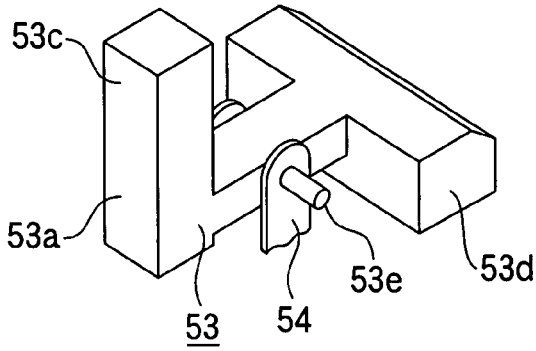
FIG. 6B is a perspective view of a coupling lever.
Figure 8:
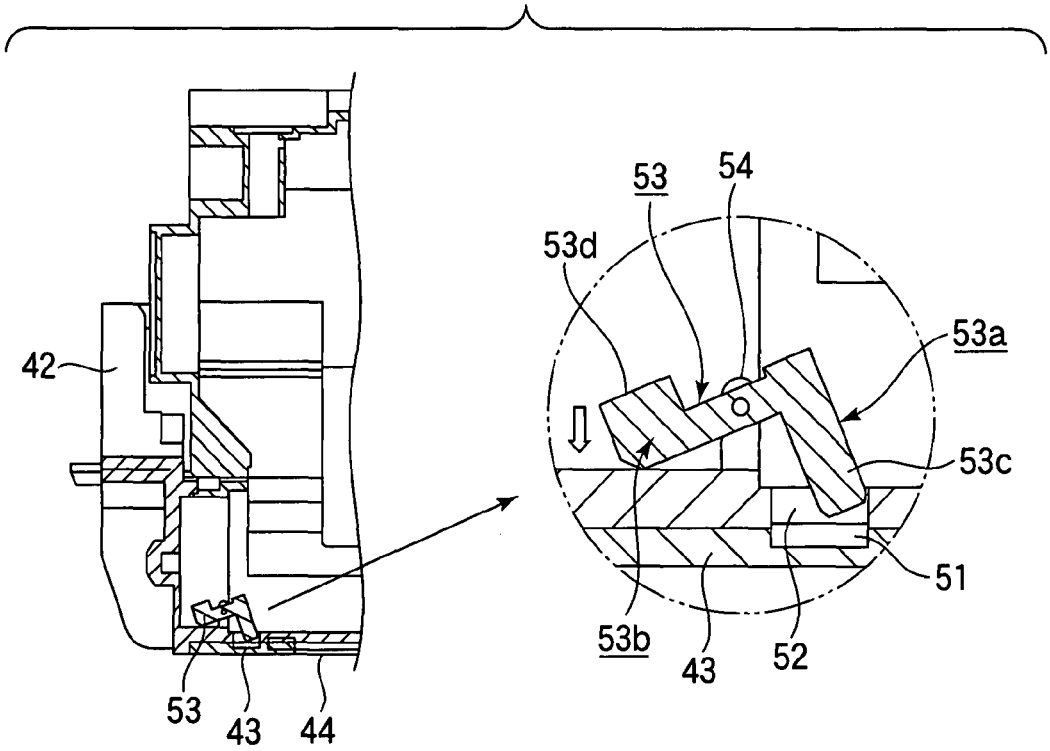
FIG. 8 is another cross-sectional view illustrating a pertinent portion of the toner cartridge.
Figure 9:
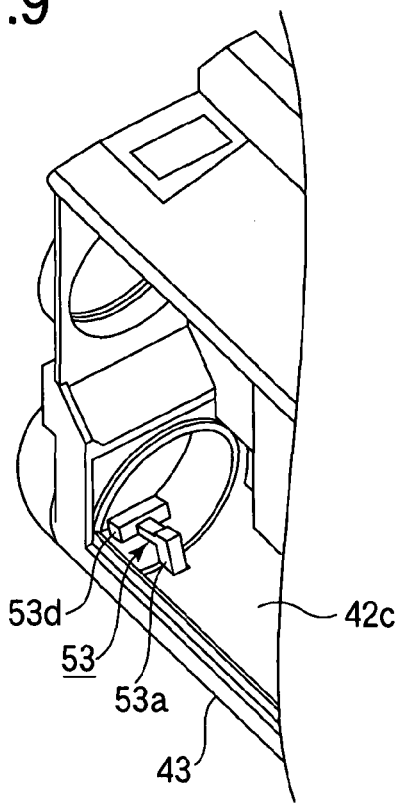
FIG. 9 is another perspective view illustrating a pertinent portion of the toner cartridge.

FIG. 6A is a cross-sectional view illustrating a pertinent portion of the toner cartridge 41. FIG. 6B is a perspective view of a coupling lever 53. FIG. 7 is a perspective view illustrating a pertinent portion of the toner cartridge 41. FIG. 8 is another cross-sectional view illustrating a pertinent portion of the toner cartridge. FIG. 9 is another perspective view illustrating a pertinent portion of the toner cartridge 41.

The casing 43 has an inner circumferential surface in which a circumferentially extending groove 51 having a predetermined depth is formed. The arcuate wall 42*c* of the shutter 42 includes a hole 52 formed therein, the hole 52 being in alignment with the groove 51 when the toner outlet 44 is completely closed.

The coupling lever (enabling-and-disabling member or coupling member) 53 is substantially in the shape of "L" and is pivotally supported on a bearing 54 mounted on the shutter 42. The coupling lever 53 is movable either to an engagement position or to a disengagement position. The coupling lever 53 includes a first portion 53*a* and a second portion 53*b*. The first portion 53*a* includes an engagement portion 53*c* formed at its end portion. The engagement portion 53*c* is engageable with and disengageable form the groove 51. The second portion 53*b* includes a weight 53*d* formed at its end portion such that the coupling lever 53 pivots due to the gravitational force about pins 53*e* that extend oppositely from the second portion 53*b* in the vicinity of the first portion 53*a*.

{Operation of Coupling Lever}

The operation of the coupling lever 53 will be described.

Referring to FIGS. 6 and 7, when the toner cartridge is held substantially horizontal with the toner outlet 44 facing upwardly, the coupling lever 53 is at the engagement position where the weight 53*d* descends due to gravity and an engagement portion 53*c* ascends. Thus, the engagement portion 53*c* extends through the hole 52 into contact with the bottom of the groove 51, thereby causing the casing 43 to couple to the shutter 42 to prevent rotation of the shutter 42.

Referring to FIGS. 8 and 9, when the toner cartridge 41 is held substantially horizontal with the toner outlet 44 facing downwardly, the operation lever 53 is at the disengagement position where the weight 53*d* descends due to gravity to contact the inner circumferential surface of the shutter 42 and the engagement portion 53*c* ascends. Thus, the engagement portion 53*c* moves out of engagement with the casing 43 and the shutter 42, thereby allowing the shutter 42 to be rotated.

As described above, the groove 51 is formed in the casing 43 while the hole 52 is formed in the shutter 42. The operation lever 53 is disposed such that the operation lever 53 may engage and disengage from the groove 51 and the hole 52. Holding the toner cartridge 41 horizontal with the toner outlet 44 facing upwardly causes the operation lever 53 to couple the casing 43 to the shutter 42, preventing the shutter 42 from rotating. This prevents inadvertent opening of the toner outlet 44, and is effective in preventing foreign matter from entering the toner cartridge 41.

Holding the toner cartridge 41 horizontal with the toner outlet 44 facing downwardly causes the casing 43 to disengage from the shutter 42, allowing the shutter 42 to rotate. This allows the toner to be discharged from the toner cartridge 41.

Second Embodiment

Elements similar to those of the first embodiment have been given the same reference numerals and their description is omitted.

Figure 10:
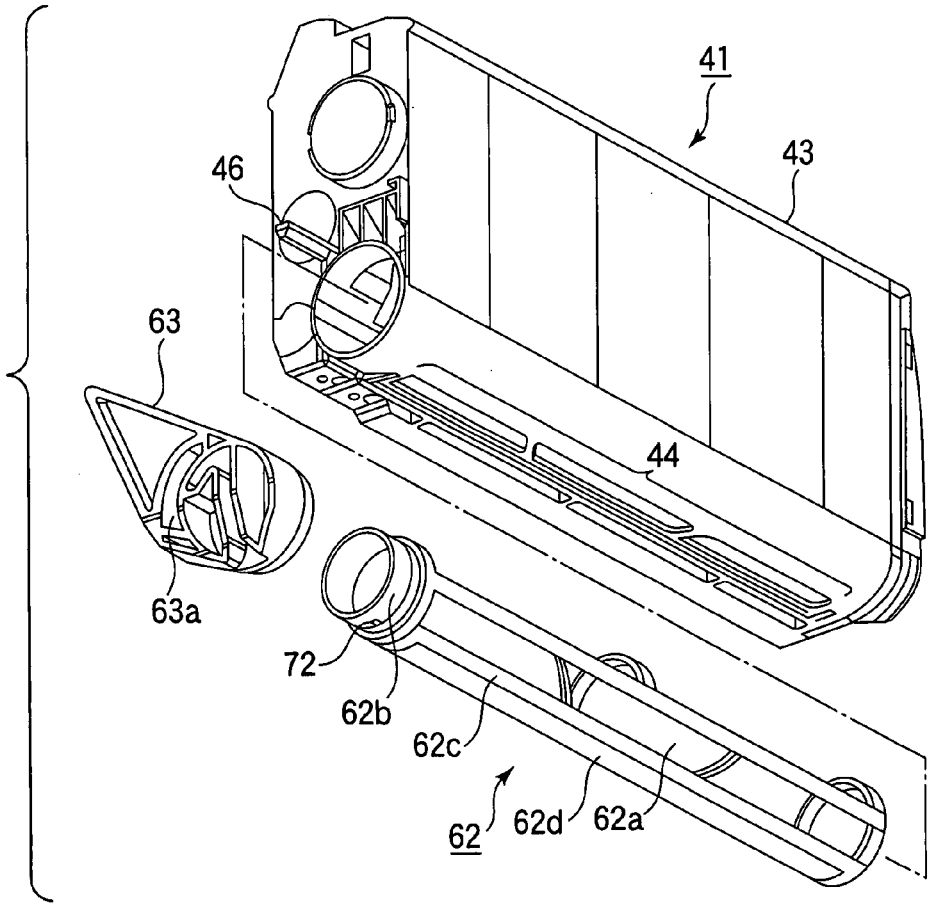
FIG. 10 is an exploded perspective view of a toner cartridge of a second embodiment.
Figure 11:
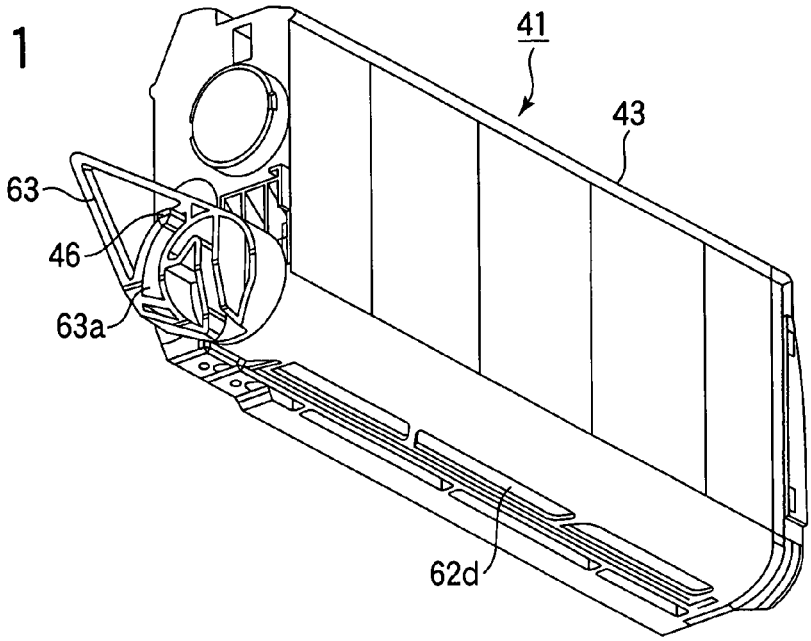
FIG. 11 is a perspective view illustrating a shutter of the second embodiment.

FIG. 10 is an exploded perspective view of a toner cartridge 41 of a second embodiment. FIG. 11 is a perspective view illustrating a shutter 62 of the second embodiment.

The shutter 62 includes an arcuate wall 62*c* that closes the toner outlet 44 and an opening 62*a* that may be brought into alignment with the toner outlet 44. A sealing member 62*d* is bonded to the outer convex circumferential surface of the arcuate wall 62*c*, thereby preventing the fresh toner from leaking out of the toner cartridge 41. An operation lever 63 fits over a cylindrical portion 62*b* formed at a longitudinal end portion of the shutter 62, and is slidable relative to the cylindrical portion 62*b*. A stopper 46 is provided on the casing 43. The operation lever 63 is supported by a support (not shown) formed on the casing 43 so that the operation lever 63 will not drop from the toner cartridge 41. The operation lever 63 is fitted over the cylindrical portion 62*b* such that the stopper 46 extends through an arcuate through hole 63*a* formed in the operation lever 63. The operation lever 63 may be pivoted through an angle from an angular position (closing position) where the stopper 46 abuts one longitudinal end of the through hole 63*a* to another angular position (opening position) where the stopper 46 abuts another end of the through hole 63*a*. Thus, the stopper 46 limits the rotation of the operation lever 63.

Figure 12A:
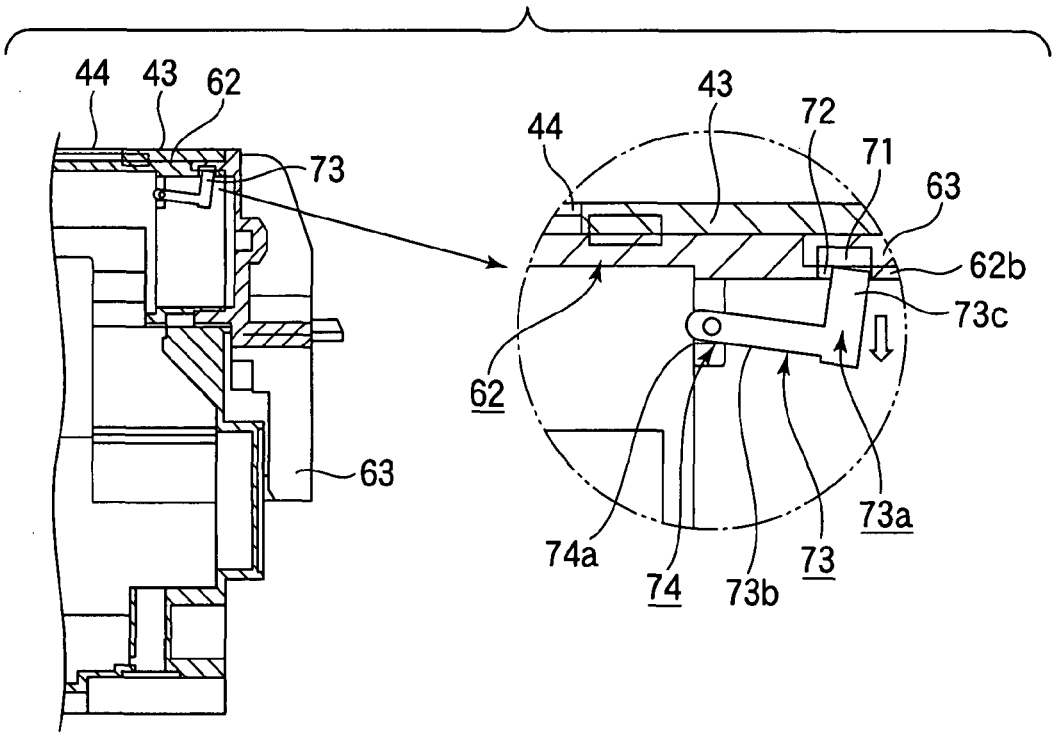
FIG. 12A is a first cross-sectional view illustrating a pertinent portion of the toner cartridge.
Figure 13:
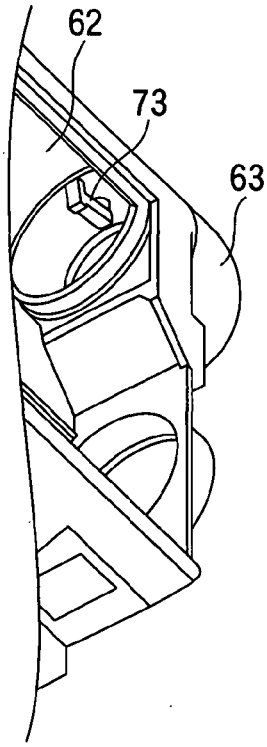
FIG. 13 is a perspective view illustrating a pertinent portion of the toner cartridge of FIG. 10.
Figure 12B:
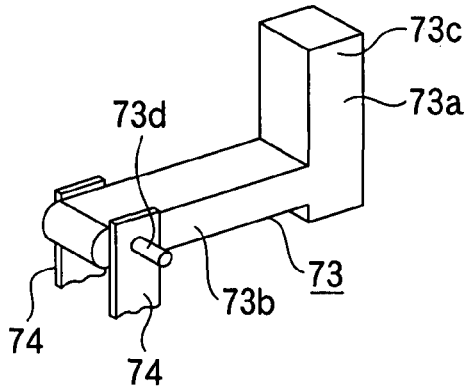
FIG. 12B is a perspective view of a coupling lever.
Figure 14:
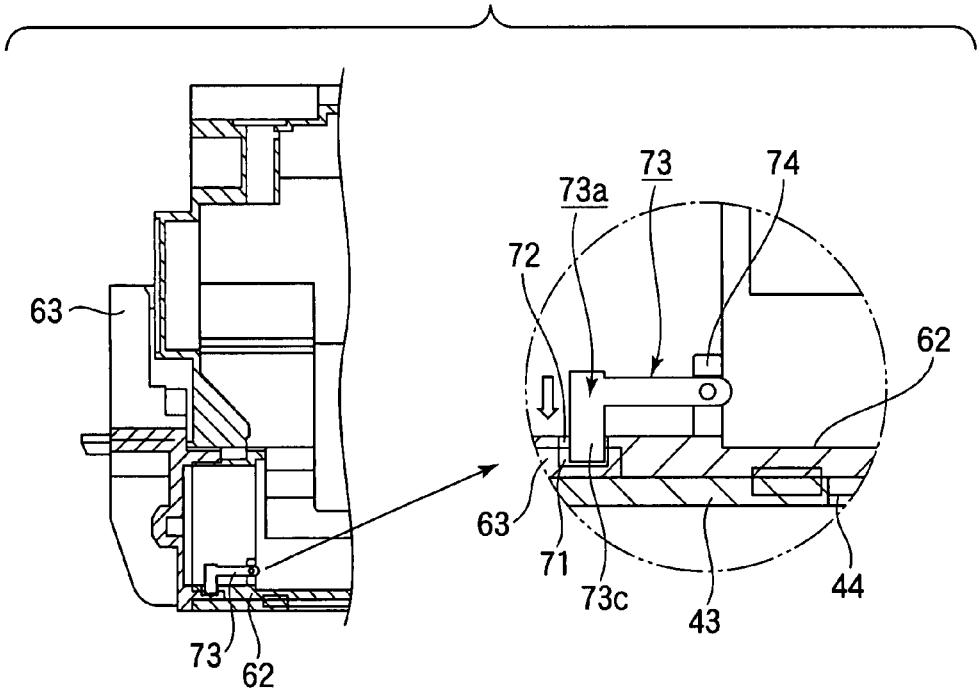
FIG. 14 is another cross-sectional view illustrating a pertinent portion of the toner cartridge of FIG. 10.
Figure 15:
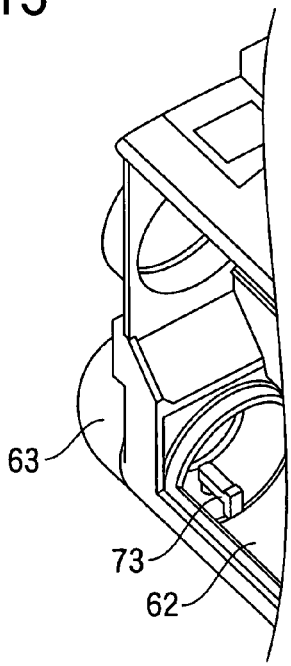
FIG. 15 is another perspective view illustrating a pertinent portion of the toner cartridge of FIG. 10.

FIG. 12A is a first cross-sectional view illustrating a pertinent portion of the toner cartridge. FIG. 12B is a perspective view of a coupling lever 73. FIG. 13 is a perspective view illustrating a pertinent portion of the toner cartridge 41. FIG. 14 is another cross-sectional view illustrating a pertinent portion of the toner cartridge 41. FIG. 15 is another perspective view illustrating a pertinent portion of the toner cartridge 41.

A hole 72 is formed in the cylindrical portion 62*b* at a position where the hole 72 is lowest in a gravitational direction when the shutter 62 completely closes the toner outlet 44. The operation lever 63 includes an inner surface slidable on the outer surface of the cylindrical portion 62*b* when the lever 63 has fitted over the cylindrical portion 62*b*. A groove 71 is formed in the inner surface of the operation lever 63 at a position where the groove 71 is in alignment with the hole 72 when the operation lever 63 is rotated to the closing position.

An L-shaped coupling lever (coupling member) 73 includes pins 73*d* oppositely project such that the coupling lever is pivotally supported by a bearing 74 on the shutter 62. The coupling lever 73 includes a first portion 73*a* and a second portion 73*b*. The first portion 73*a* includes an engagement portion 73*c* that extends through the hole 72 into the groove 71. The engagement portion 73*c* is engageable with and disengageable form the groove 71. Due to its own weight, the coupling lever 73 pivots about an axis passing through an end portion of the second portion 73*b*. The bearing 74 includes a stopper surface 74*a* that limits the angular position of the coupling lever 73 when the coupling lever 73 pivots.

{Operation of Coupling Lever}

The operation of the coupling lever 73 will be described.

Referring to FIGS. 12 and 13, when the toner cartridge 41 is held substantially horizontal with the toner outlet 44 facing upwardly, the coupling lever 73 is at a disengagement position where the first portion 73*a* descends due to its gravity until the second portion 73*b* abuts the stopper surface 74*a* to stop. Thus, the engagement portion 73*c* no longer remains extending in the groove 71. This causes the shutter 62 to disengage from the operation lever 63, so that rotating the operation lever 63 will not cause the shutter 62 to rotate.

Referring to FIGS. 14 and 15, holding the cartridge 41 substantially horizontal with the toner outlet 44 facing downwardly, the coupling lever 73 is at an engagement position where the first portion 73*a* descends due to its gravity until the engagement portion 73*c* extends through the hole 72 into contact with the bottom of the groove 71. This causes the shutter 62 to couple to the operation lever 63, allowing the shutter 62 to rotate when the operation lever 63 is operated.

As described above, the operation lever 63 includes the groove 71 formed therein while the cylindrical portion 62*b* of the shutter 62 includes the hole 72 formed therein. Holding the toner cartridge 41 horizontal with the toner outlet 44 facing upwardly causes the shutter 62 to move out of coupling engagement with the operation lever 63. Thus, inadvertently operating the operation lever 63 will not cause the shutter 62 to rotate, failing to open the toner outlet 44. This configuration is effective in preventing foreign matter from entering the toner cartridge 41.

Holding the toner cartridge 41 substantially horizontal with the toner outlet 44 facing downwardly causes the shutter 62 to move into coupling engagement with the operation lever 63, allowing the shutter 62 to rotate. This allows the toner cartridge 41 to discharge the toner.

Third Embodiment

Elements similar to those of the first and second embodiments have been given the same reference numerals and their description is omitted.

Figure 16:
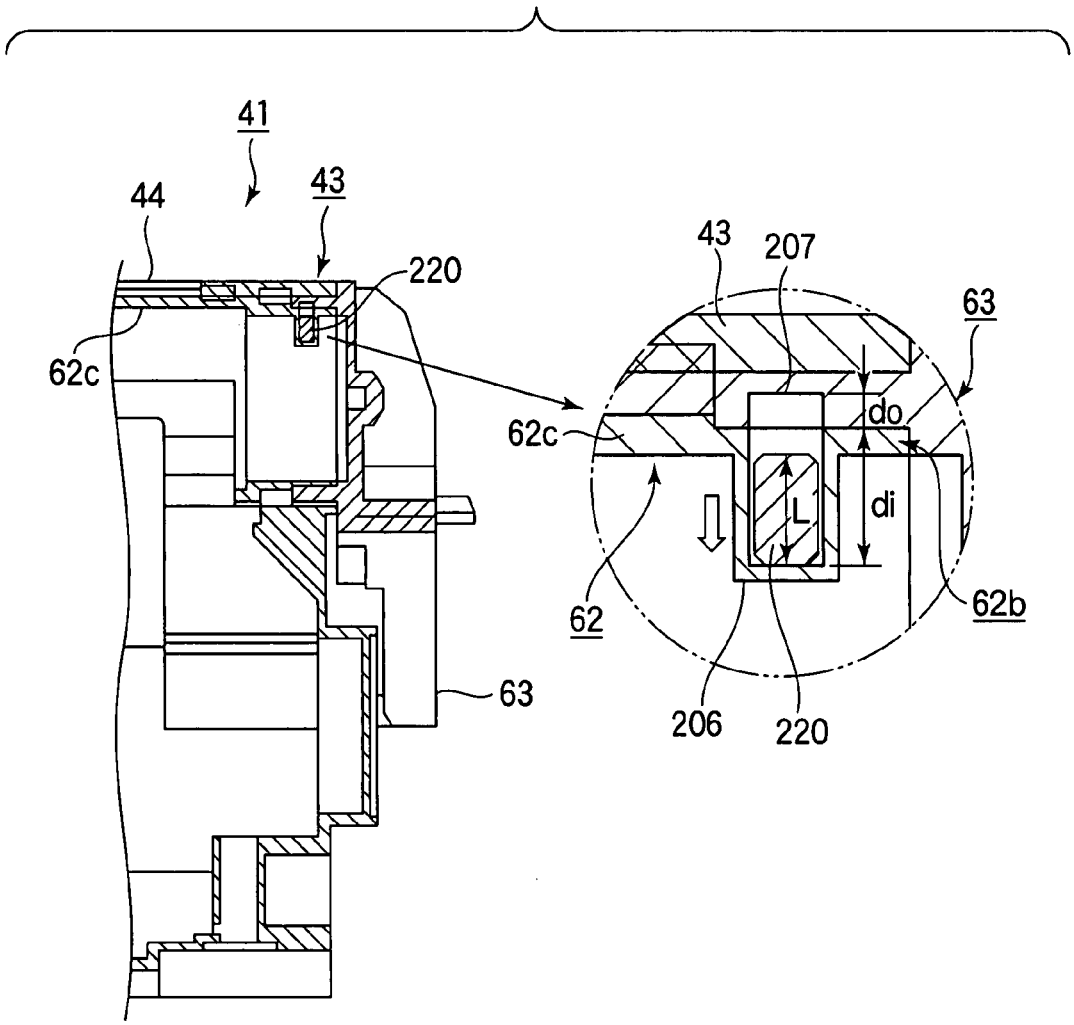
FIG. 16 is a cross-sectional view illustrating a pertinent portion of a toner cartridge of a third embodiment.
Figure 17:
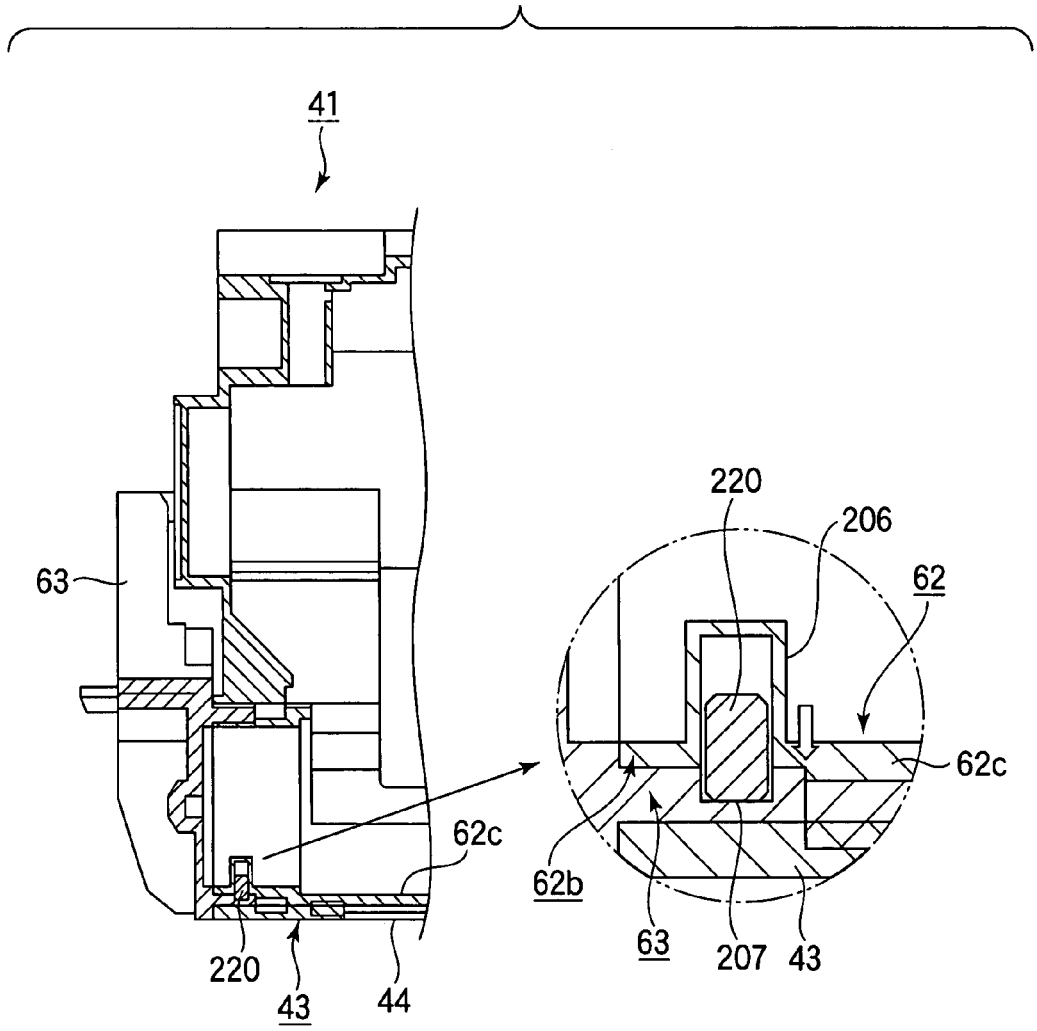
FIG. 17 is a cross-sectional view illustrating a pertinent portion of the toner cartridge of FIG. 16.

FIG. 16 is a cross-sectional view illustrating a pertinent portion of a toner cartridge of a third embodiment. FIG. 17 is a cross-sectional view illustrating a pertinent portion of the toner cartridge 41.

A shutter 62 includes an arcuate wall 62*c* and a cylindrical portion 62*b*. When the operation lever 63 is operated to a closing position, the arcuate wall 62*c* closes the toner outlet 44. An inner recess 206 is formed in the cylindrical portion 62*b* at a position where the inner recess 206 is lowest in a gravitational direction when the shutter 62 completely closes the toner outlet 44. The operation lever 63 includes an inner circumferential surface that slides on the cylindrical portion 62*b*, and an outer recess 207 formed in the inner circumferential surface. When the operation lever 63 is operated to the closing position, the outer recess 207 is in communication with the inner recess 206. In other words, the outer recess 207 is in communication with the inner recess 206 or out of communication with the inner recess 206, depending on the position of the operation lever 63.

When the outer recess 207 is in communication with the inner recess 206, a coupling piece 220 is slidable in the inner recess 206 and outer recess 207 due to gravity. The coupling piece 220 may take the form of a short pin. Once a part of the coupling piece 220 enters the inner recess 206, the operation lever 63 is coupled to the shutter 62. Referring to FIG. 16, the coupling piece 220, inner recess 206, and outer recess 207 are related such that Do<L<Di, where L is a length of the coupling piece 220, Di is a depth of the inner recess 206, and Do is a depth of the outer recess 207. The inner recess 206 and outer recess 207 have a circular cross-section with substantially the same diameter. The coupling piece 220 has a circular cross-section. The diameter of the circular cross section of the coupling piece 220 is slightly smaller than the inner diameter of the inner recess 206 and the outer recess 207 such that the coupling piece 220 may slide smoothly in the inner recess 206 and outer recess 207.

The operation of the coupling piece 220 will be described.

Referring to FIG. 16, when the toner cartridge 41 is held substantially horizontal with the toner outlet 44 facing upwardly, the coupling piece 220 descends due to gravity to take up a disengagement position where the coupling piece 220 no longer engages the outer recess 207. Thus, the shutter 62 disengages from the operation lever 63, so that operating the operation lever 63 will not cause the shutter 62 to rotate.

Referring to FIG. 17, when the toner cartridge 41 is held substantially horizontal with the toner outlet 44 facing downwardly, the coupling piece 220 descends due to gravity to enter the outer recess 207 into contact with the bottom of the outer recess 207. This causes the shutter 62 to couple to the operation lever 63, allowing the shutter 42 to rotate.

As described above, the operation lever 63 is formed with the outer recess 207 while the cylindrical portion 62*b* is formed with the inner recess 206. The coupling piece 220 is slidable to move to a position where the coupling piece couples the operation lever 63 to the cylindrical portion 62*b*. Holding the toner cartridge 41 substantially horizontal with the toner outlet 44 facing upwardly causes the coupling piece 220 to decouple the operation lever 63 from the cylindrical portion 62*b*, so that operating the operation lever 63 will not cause the shutter 62 to rotate. This structure prevents the toner outlet 44 from being opened inadvertently, thus being effective in preventing foreign matter from entering the toner cartridge 41.

Holding the toner cartridge 41 substantially horizontal with the toner outlet 44 facing downwardly causes the coupling piece 220 to couple the operation lever 63 to the shutter 62, allowing the shutter 62 to rotate together with the operation lever 63. This allows the toner to be discharged from the toner cartridge 41.

Fourth Embodiment

Elements similar to those of the first to third embodiments have been given the same reference numerals and their description is omitted.

Figure 18A:
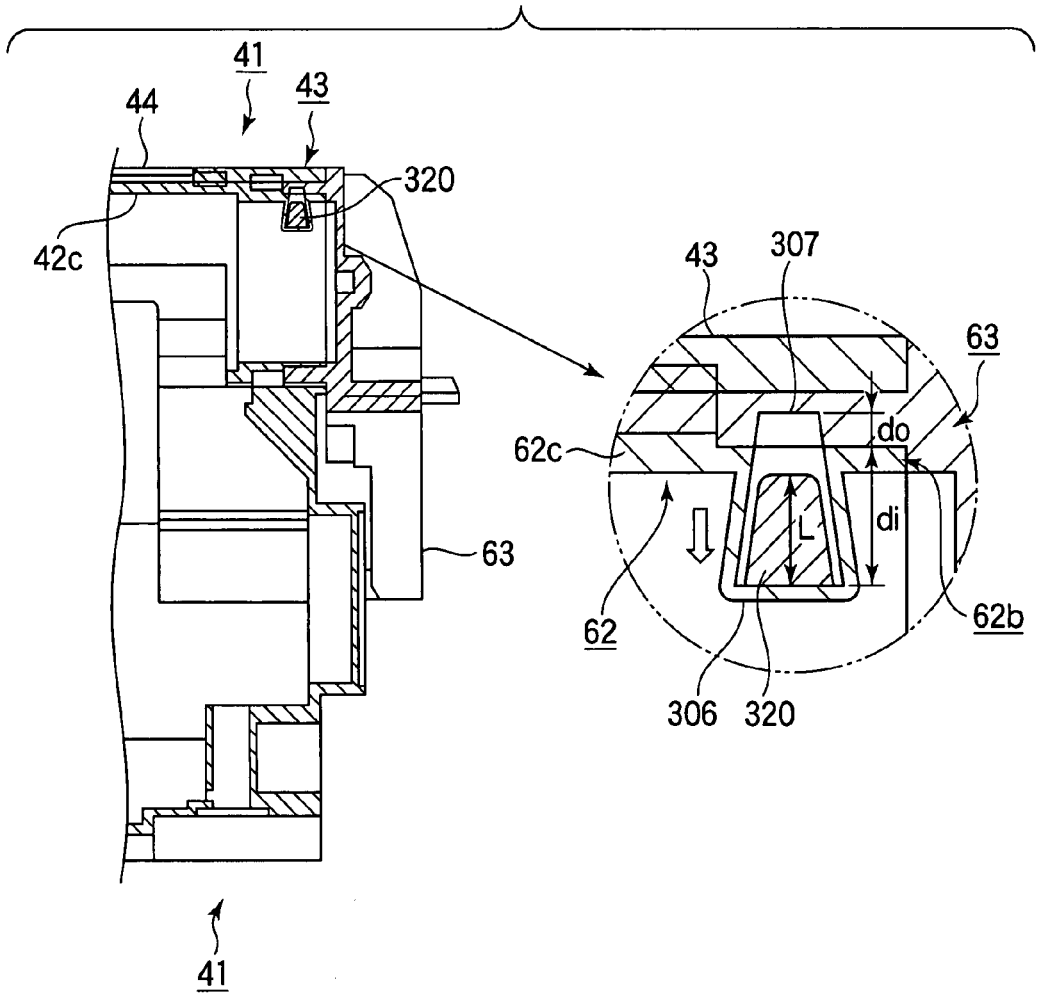
FIG. 18A is a cross-sectional view illustrating a pertinent portion of a toner cartridge of a fourth embodiment.
Figure 18B:
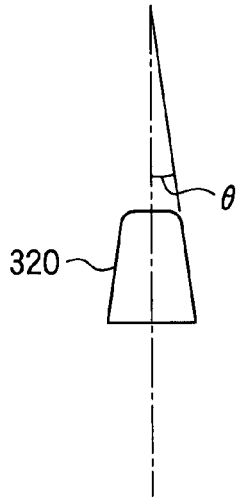
FIG. 18B is a side view of illustrates a tapered angle of a coupling piece 320.
Figure 19:
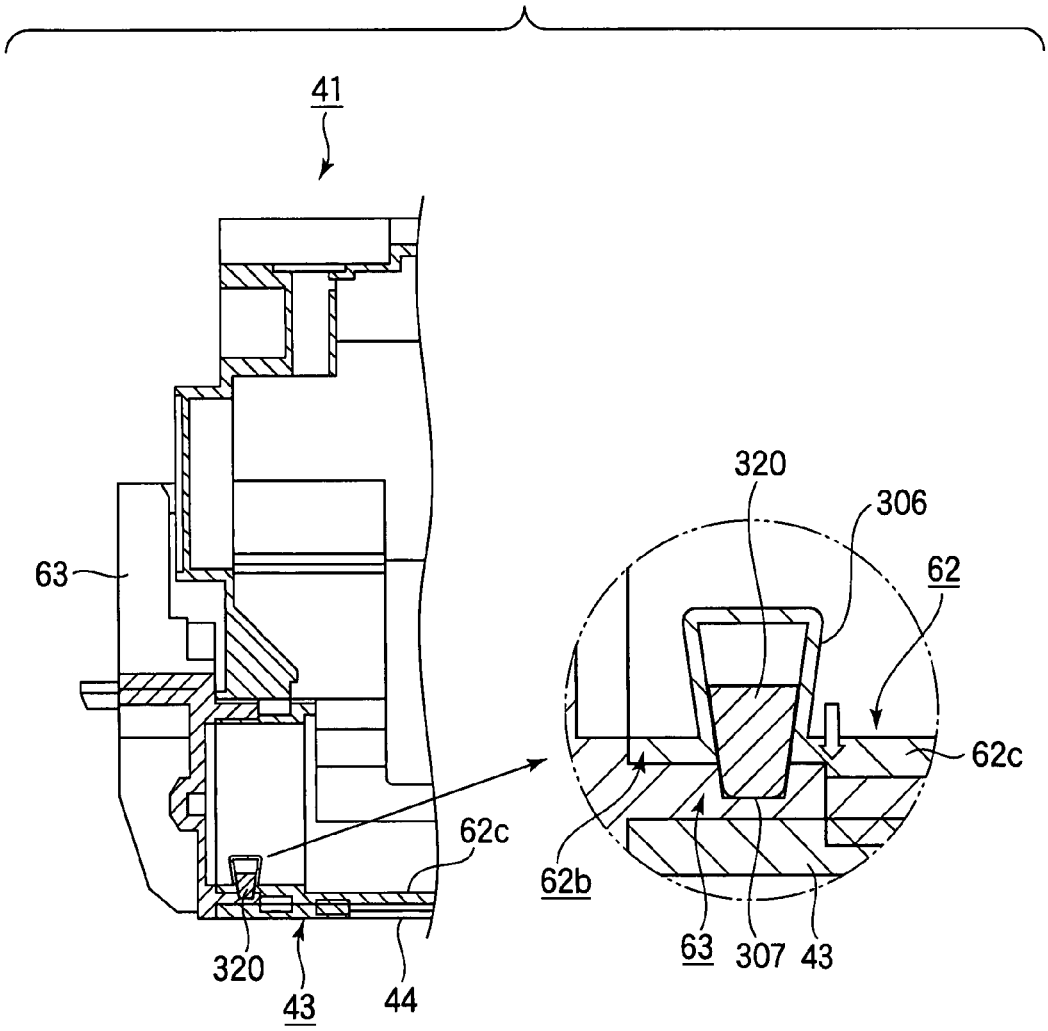
FIG. 19 is a cross-sectional view illustrating a pertinent portion of the toner cartridge of FIG. 18A.
Figure 20:
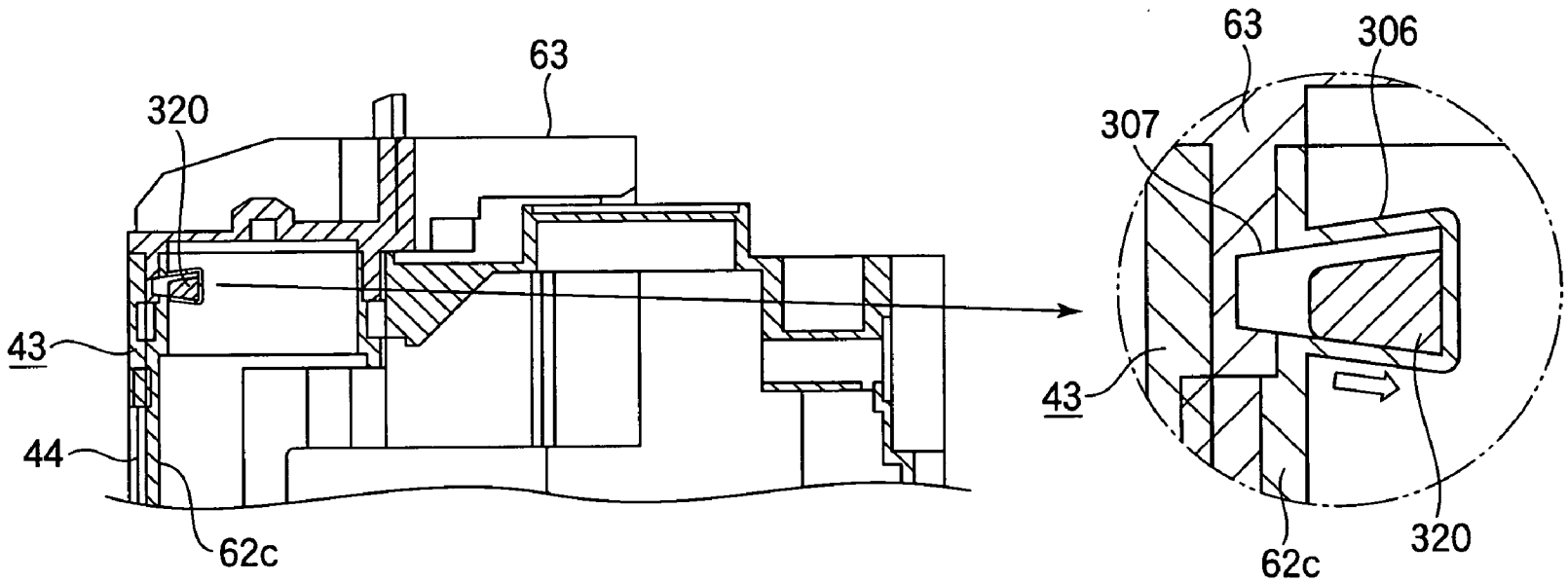
FIG. 20 is another cross-sectional view illustrating a pertinent portion of the toner cartridge of FIG. 18A.
Figure 21:
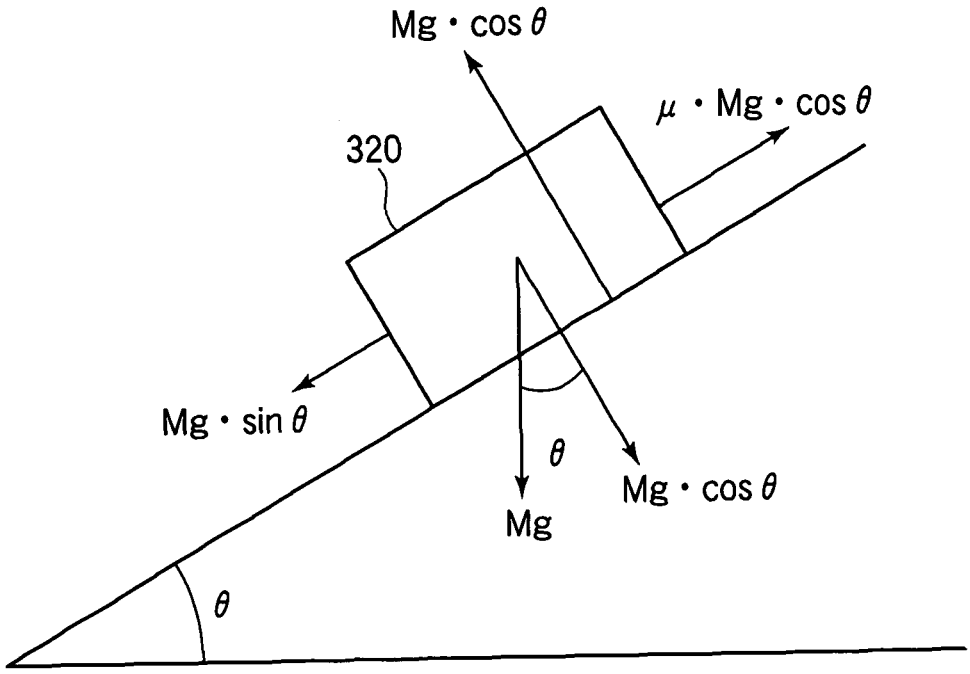
FIG. 21 illustrates the method for setting a taper angle in the fourth embodiment.

FIG. 18A is a cross-sectional view illustrating a pertinent portion of a toner cartridge 41 of a fourth embodiment. FIG. 18B is a side view of illustrates a tapered angle of a coupling piece 320. FIG. 19 is another cross-sectional view illustrating a pertinent portion of the toner cartridge 41. FIG. 20 is still another cross-sectional view illustrating a pertinent portion of the toner cartridge 41. FIG. 21 illustrates how a taper angle in the fourth embodiment is selected.

Referring to FIGS. 18A and 19, a shutter 62 for closing and opening a toner outlet 44 includes a hollow cylindrical portion 62*b*. The cylindrical portion 62*b* includes an inner groove 306 formed therein. The inner groove 306 has a circular cross section and is tapered toward the outer surface of the cylindrical portion 62*b*. The inner groove 306 is formed at a position where the inner groove 306 is lowest in a gravitational direction when the shutter 62 closes the toner outlet 44.

The operation lever 63 includes a cylindrical inner surface that may be in slidable contact with the outer surface of the cylindrical portion 62*b* after the operation lever 63 has fitted over the cylindrical portion 62*b*. An outer groove 307 is formed in the cylindrical inner surface of the operation lever 63 at a position where the outer groove 307 becomes aligned with the inner recess 206 when operation lever 63 is rotated until the shutter 62 completely closes the toner outlet 44.

The outer groove 307 has a circular cross section and is tapered radially outwardly. In other words, the wall surface of the outer groove 307 lies in substantially the same tapered plane as the wall surface of the inner groove 306.

The coupling piece 320 is received in the inner groove 306, and is slidable, due to gravity, to move to a position where the coupling piece 320 couples the operation lever 63 to the cylindrical portion 62*b*. The coupling piece 320 may take the form of a short conical pin. Referring to FIG. 18A, the coupling piece 320, inner groove 306, and outer groove 307 are related such that Do<L<Di, where L is a length of the coupling piece 320, Di is a depth of the inner groove 306, and Do is a depth of the outer groove 307.

The coupling piece 320 has a circular cross section, and is therefore smoothly movable in the inner groove 306 and outer groove 307 when the inner groove 306 is in alignment with the outer groove 307. The coupling piece 320 has substantially the same taper angle as the inner groove 306 and outer groove 307.

The operation of the coupling piece 320 will be described. Referring to FIG. 18A, holding the toner cartridge 41 substantially horizontal with the toner outlet 44 facing upwardly causes the coupling piece 320 to descend due to gravity, so that the coupling piece 320 is at a disengagement position where the shutter 62 does not couple to the operation lever 63. The coupling piece 320 is received completely in the inner groove 306 because the length L of the coupling piece 320 is smaller than the depth Di of the inner groove 306. Thus, no part of the coupling piece 320 extends into the outer groove 307, so that the shutter 62 no longer couples to the operation lever 63. Thus, rotating the operation lever 63 will not cause the shutter 62 to rotate.

Holding the toner cartridge 41 substantially horizontal with the toner outlet 44 facing downwardly causes the coupling piece 320 to descend due to gravity, so that the coupling piece 320 is at an engagement position where the shutter 62 couples to the operation lever 63. The coupling piece 320 is received in the inner groove 306 but remains received partly because the length L of the coupling piece 320 is larger than the depth Do of the outer groove 307. Thus, a part of the coupling piece 320 still extends into the outer groove 307, so that the shutter 62 couples to the operation lever 63. Thus, rotating the operation lever 63 will cause the shutter 62 to rotate. The coupling piece 320 has dimensions such that when the coupling piece 320 is received in the outer groove 307, the outer surface of the coupling piece 320 lies in substantially the same plane as the wall surfaces of the inner groove 306 and outer groove 307.

When the toner cartridge 41 is tilted by 90 degrees counterclockwise in a vertical plane about a longitudinal middle portion of the toner cartridge 41 from a position where the toner outlet 44 faces upward as shown in FIG. 18A, the coupling piece 320 remains in contact with the bottom of the inner groove 306 as shown in FIG. 20. Likewise, when the toner cartridge 41 is tilted by 90 degrees clockwise in a vertical plane about the longitudinal middle portion of the toner cartridge 41 as shown in FIG. 18A, the coupling piece 320 also remains in contact with the bottom of the inner groove 306 as shown in FIG. 20.

In other words, the coupling piece 320 also remains in contact with the bottom of the inner groove 306 if the toner cartridge 41 is tilted within 90 degrees counterclockwise or clockwise in a vertical plane about the longitudinal middle portion of the toner cartridge.

When the toner cartridge is rotated by 90 degrees counterclockwise or clockwise in FIG. 19 from a position where the toner outlet 44 faces downwardly, if the coupling piece 320 remains in contact with the bottom of the outer groove 307 as shown in FIG. 19, the shutter 62 and the operation lever 63 remain coupled with each other so that the shutter 62 may still be rotated.

Thus, the taper angle of the outer groove 307 and inner groove 306 may be selected such that the coupling piece 320 slides toward the bottom of the inner groove 306 when the toner cartridge 41 is tilted by 90 degrees counterclockwise or clockwise in FIG. 19 from a position where the toner outlet 44 faces downwardly.

Thus, the taper angle of the outer groove 307 and inner groove 306 is selected such that $45° \geqq \theta \geqq 22°$ where $\theta$ is the taper angle of the outer groove 307 and inner groove 306. This range of taper angle ensures that the coupling piece 320 slides downward in the inner groove 306 toward the bottom of the inner groove 306 when the toner cartridge 41 is tilted by 90 degrees clockwise or counterclockwise in a vertical plane.

A taper angle greater than 45 degrees causes a larger bottom area of the inner groove 306, necessitating a larger space for forming the inner groove 306 and outer groove 307.

A taper angle smaller than 20 degrees makes it difficult for the coupling piece 320 to smoothly slide toward the bottom of the inner groove 306.

If both the shutter 62 and the operation lever 63 are formed of ABS resin, and the coupling piece 320 is formed of stainless steel (SUS), the following relation should be satisfied.

$$Mg \cdot \sin\theta \geqq \mu \cdot Mg \cdot \cos\theta$$

$$\theta \geqq \tan^{-1}\mu \approx 20°$$

where $\mu$ is a static friction coefficient between ABS resin and stainless steel, $\theta$ is a taper angle, and Mg is the weight of the coupling piece 320.

It is assumed that $\mu$ is 0.37 and Mg is 0.3 g.

Therefore, the aforementioned taper angle $\theta$ is given as follows:

$$\theta \geqq 20°$$

As described above, the outer groove 307 is formed on the operation lever 63 side while the inner groove 306 is formed on the cylindrical portion 62*b* side. The coupling piece 320 slides in the outer groove 307 and the inner groove 306 to couple the operation lever 63 to the shutter 62 or to decouple the operation lever 63 from the shutter 62. This configuration of the inner groove 306, outer groove 307, and coupling piece 320 is effective in preventing the toner outlet 44 from being inadvertently opened so that no foreign matter enters the toner cartridge 41.

While the present invention has been described with respect to a printer, the present invention may also be applied to other apparatuses such as facsimile machines, copying machines, and multi function peripheral (MFP) devices.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer material container, comprising:

a holding body that holds a developer material therein, said holding body including a discharging opening;

a shutter member movably assembled to said holding body, said shutter member being movable either to an opening position where said shutter member opens the discharging opening or to a closing position where said shutter member closes the discharging opening;

an operation member operated to move said shutter member to either the opening position or to the closing position; and an enabling-and-disabling member that moves between said operation member and said shutter member to engage said operation member to, or disengage said operation member from, said shutter member depending on an orientation of the discharging opening, said operation member and said shutter member being movable in unison relative to said holding body when in an engagement.

2. The developer material container according to claim 1, wherein said enabling-and-disabling member allows said shutter member to move relative to said holding body when said the developer material container is held with the discharging opening facing upwardly in a gravitational direction, and does not allow said shutter member to move relative to said holding body when the developer material container is held with the discharging opening facing downwardly in the gravitational direction.

3. The developer material container according to claim 2, wherein said enabling-and-disabling member is supported on said shutter member such that said enabling-and-disabling member is pivotal by gravity, said enabling-and-disabling member including an engagement portion at a free end thereof, the engagement portion being engageable with an engagement portion formed on said holding body.

4. The developer material container according to claim 1, wherein said enabling-and-disabling member is supported on said shutter member such that said enabling-and-disabling member is pivotal by gravity, said enabling-and-disabling member including an engagement portion at a free end thereof, the engagement portion being engageable with an engagement portion formed on said holding body.

5. The developer material container according to claim 1, wherein said enabling-and-disabling member couples said shutter member to said holding body when the developer material container is held with the discharging opening facing upwardly in a gravitational direction, and decouples said shutter member from said holding body when the developer material container is held with the discharging opening facing downwardly in the gravitational direction.

6. The developer material container according to claim 5, wherein said enabling-and-disabling member is supported on said shutter member such that said enabling-and-disabling member is pivotal by gravity, said enabling-and-disabling member including an engagement portion at a free end thereof, the engagement portion being engageable with an engagement portion formed on said holding body.

7. The developer material container according to claim 1, wherein when the developer material container is held with the discharging opening facing downwardly in a gravitational direction, said enabling-and-disabling member couples said shutter member to said operation member;

wherein when the developer material container is held with the discharging opening facing upwardly in a gravitational direction, said enabling-and-disabling member decouples said shutter member from said operation member; and wherein when the developer material container is tilted by an angle in a vertical plane from a position where the developer material container is held with the discharging opening facing upwardly in a gravitational direction, said enabling-and-disabling member decouples said shutter member from said operation member.

8. The developer material container according to claim 7, wherein the said shutter member includes a first tapered recess and said operation member includes a second tapered recess;

wherein said enabling-and-disabling member is movable in the first tapered recess and the second tapered recess by gravity when said shutter member is positioned relative to said operation member such that the first tapered recess is in alignment with second tapered recess.

9. The developer material container according to claim 1, wherein said shutter member includes a first tapered recess and said operation member includes a second tapered recess;

wherein said enabling-and-disabling member is movable in the first tapered recess and the second tapered recess by gravity when said shutter member is positioned relative to said operation member such that the first tapered recess is in alignment with second tapered recess.

10. An image forming unit incorporating said developer material container according to claim 1.

11. An image forming apparatus incorporating said image forming unit according to claim 10.

12. A developer material container, comprising:

a holding body that holds a developer material therein, said holding body including a discharging opening;

a shutter member movably assembled to said holding body, said shutter member being movable either to an opening position where said shutter member opens the discharging opening or to a closing position where said shutter member closes the discharging opening;

an operation member operated to move said shutter member to either the opening position or to the closing position; and an enabling-and-disabling member that allows or does not allow said operation member to move said shutter member relative to said holding body depending on an orientation of the discharging opening;

wherein said operation member and said shutter member are separate components;

wherein when the developer material container is held with the discharging opening facing upwardly in a gravitational direction, said enabling-and-disabling member decouples said shutter member from said operation member; and wherein when said the developer material container is held with the discharging opening facing downwardly in a gravitational direction, said enabling-and-disabling member couples said shutter member to said operation member.

13. The developer material container according to claim 12, wherein said enabling-and-disabling member is pivotally supported on said shutter member, said enabling-and-disabling member including an engagement portion at a free end thereof, the engagement portion being engageable with an engagement portion formed in said operation member.

14. The developer material container according to claim 12, wherein said shutter member includes a first recess and said operation member includes a second recess;

wherein when said enabling-and-disabling member couples said operation member to said shutter member, said enabling-and-disabling member is movable in the first recess and the second recess by gravity.

15. The developer material container according to claim 14, wherein said enabling-and-disabling member is a pin.

16. A developer material container comprising:

a holding body that holds a developer material therein, said holding body including a discharging opening;

a shutter member movably assembled to said holding body, said shutter member being movable either to an opening position where said shutter member opens the discharging opening or to a closing position where said shutter member closes the discharging opening;

an operation member operated to move said shutter member to either the opening position or to the closing position; and an enabling-and-disabling member that allows or does not allow said operation member to move said shutter member relative to said holding body depending on an orientation of the discharging opening; wherein said shutter member includes a first recess and said operation member includes a second recess; and when said enabling-and-disabling member couples said operation member to said shutter member, said enabling-and-disabling member is movable in the first recess and the second recess by gravity.

17. The developer material container according to claim 16, wherein said enabling-and-disabling member is a pin.

* * * * *